United States Patent [19]

Zindikus et al.

[11] 4,021,113

[45] May 3, 1977

[54] CLEANING DEVICE FOR ELECTROSTATIC COPIERS

[75] Inventors: Walter Zindikus, Munich; Heinz Kröbel, Taufkirchen; Walter Franke, Munich, all of Germany

[73] Assignee: AGFA-Gevaert, A.G., Leverkusen, Germany

[22] Filed: Feb. 17, 1976

[21] Appl. No.: 658,604

[30] Foreign Application Priority Data

Feb. 19, 1975 Germany ..... 2507151

[52] U.S. Cl. ..... 355/15; 15/256.52

[51] Int. Cl.[2] ..... G03G 21/00

[58] Field of Search ..... 355/15; 15/256.5, 256.51, 15/256.52, 1.5; 118/637

[56] References Cited

UNITED STATES PATENTS

| | | | |
|---|---|---|---|
| 3,625,605 | 12/1971 | Schnell et al. | 355/15 |
| 3,667,840 | 6/1972 | Engel et al. | 355/15 X |
| 3,672,764 | 6/1972 | Hartwig et al. | 355/15 |
| 3,784,297 | 1/1974 | Ito et al. | 355/15 X |
| 3,879,124 | 4/1975 | Eppe | 355/15 |
| 3,940,282 | 2/1976 | Hwa | 355/15 X |

*Primary Examiner*—Richard L. Moses
*Attorney, Agent, or Firm*—Michael J. Striker

[57] ABSTRACT

An electrostatic copier wherein an electrostatic image pattern is formed in the photoconductive surface of a rotatable endless carrier, toner particles are attracted to the patterns to form a visible image and thereupon transferred to an image carrier and a cleaning web contacts a portion of the photoconductive surface to clean it in preparation for the formation of another image pattern, a brush roller has an axis of rotation extending parallel to the axis of rotation of the endless carrier, the brush roller engaging the surface upstream of the portion as considered in the direction of rotation of the endless carrier and being rotated exclusively by frictional contact with the surface so as to remove from the surface carrier particles adhering thereto and prevent them from reaching the web.

7 Claims, 2 Drawing Figures

CLEANING DEVICE FOR ELECTROSTATIC COPIERS

BACKGROUND OF THE INVENTION

This invention relates to electrostatic copiers, and more particularly to the cleaning devices of such copiers.

In electrostatic copiers it is known to electrostatically charge the photosensitive surface of an endless, usually cylindrical, travelling carrier, thus forming a latent image of an original to be reproduced. Particles of toner powder with spherical toner carrier particles are attracted to the charged areas and adhere thereto, forming a layer. Thereupon, this layer is transferred to a copy carrier and forms thereon the desired image, i.e., a reproduction of the original. This completes a copy cycle of the machine.

Before the next copy cycle can begin, the surface of the travelling carrier must be cleaned to remove from it any residual particles and/or contaminants that may still adhere to it. For this purpose it is known to use a cleaning web or tape which contacts the carrier surface to wipe the particles off the same. A mechanism advances the tape from a supply to a take-up, so that constantly new, clean tape portions contact the carrier surface to wipe it clean.

These known cleaning arrangements are simple and inexpensive to construct, of small size and therefore readily accommodatable in the often cramped confines of the copying machines, and in general they are relatively easy in their effect on the very easily damaged photosensitive surface of the carrier.

In certain circumstances they can, however, cause severe scratching of this surface.

The spherical carrier particles are comparatively hard and large. They should theoretically, be completely removed from the photosensitive surface by the time the portions thereof from which the image has been transferred to the copy carrier, reaches the cleaning tape. However, at times some of these carrier particles do continue to adhere to the photosensitive surface and are carried to the cleaning tape, the wiping action of which then moves these carrier particles around on the surface where they can cause very substantial damage by scratching.

SUMMARY OF THE INVENTION

It is the general object of this invention to overcome the above-described disadvantage.

More particularly, it is an object of the invention to provide an improved electrostatic copier wherein the toner carrier particles are prevented from reaching the cleaning tape.

A further object is to provide an arrangement, in an electrostatic copier, which achieves the above purposes in a simple, reliable and inexpensive manner.

Pursuant to these objects, and others which will become apparent hereafter, one feature of the invention resides in an electrostatic copier wherein an electrostatic image pattern is formed in the photoconductive surface of a rotatable endless carrier, toner particles are attracted to the patterns to form a visible image and thereupon transferred to an image carrier, and a cleaning web contacts a portion of the photoconductive surface to clean it in preparation for the formation of another image pattern. In accordance with the invention the apparatus includes a brush roller having an axis of rotation extending parallel to the axis of rotation of the endless carrier, the brush roller engaging the surface upstream of the portion as considered in the direction of rotation of the endless carrier and being rotated exclusively by frictional contact with the surface so as to remove from the surface carrier particles adhering thereto and prevent them from reaching the web.

This brush roller is in no way positively driven and rotates only due to its frictional engagement with the surface of the travelling carrier. There is a slight amount of slippage between the surface and the brush roller which is frictionally entrained by the surface. Furthermore, the individual bristles of the roller which rest against the surface become somewhat deformed, i.e., deflected out of their normal position. Due to these two factors any toner carrier particles adhering to the photosensitive surface are brushed off the same by the brush roller — and are thus prevented from passing on to the cleaning tape. The removal effect results essentially from the fact that the carrier particles are moved slightly out of their original position upon contact with the brush roller, to a new location where the electrostatic forces no longer hold them on the photosensitive surface, so that the particles drop off.

It is important that the brush roller according to the invention is not subjected to a positive drive. In the known arrangements — in which a positive drive is used — the brush rollers are driven in rotation opposite to the travel of the image carrier and at relatively high speed. Such high-speed rotation was heretofore always considered to be a prerequisite for obtaining a good cleaning effect and could, of course, only be obtained by positively driving the brushes in rotation. Unfortunately, the brushes "scrubbed" the photosensitive surface during such enforced rotation and caused substantial damage to it.

In contradistinction to this, the arrangement according to the present invention produces only a small speed differential between the brush roller and the photosensitive surface. This differential results from the slippage which occurs between brush roller and photosensitive surface and is insufficient to allow any significant damage to occur to the photosensitive surface. Nevertheless, the novel arrangement produces the desired, fully adequate cleaning effect in terms of removing the toner carrier particles from the surface.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
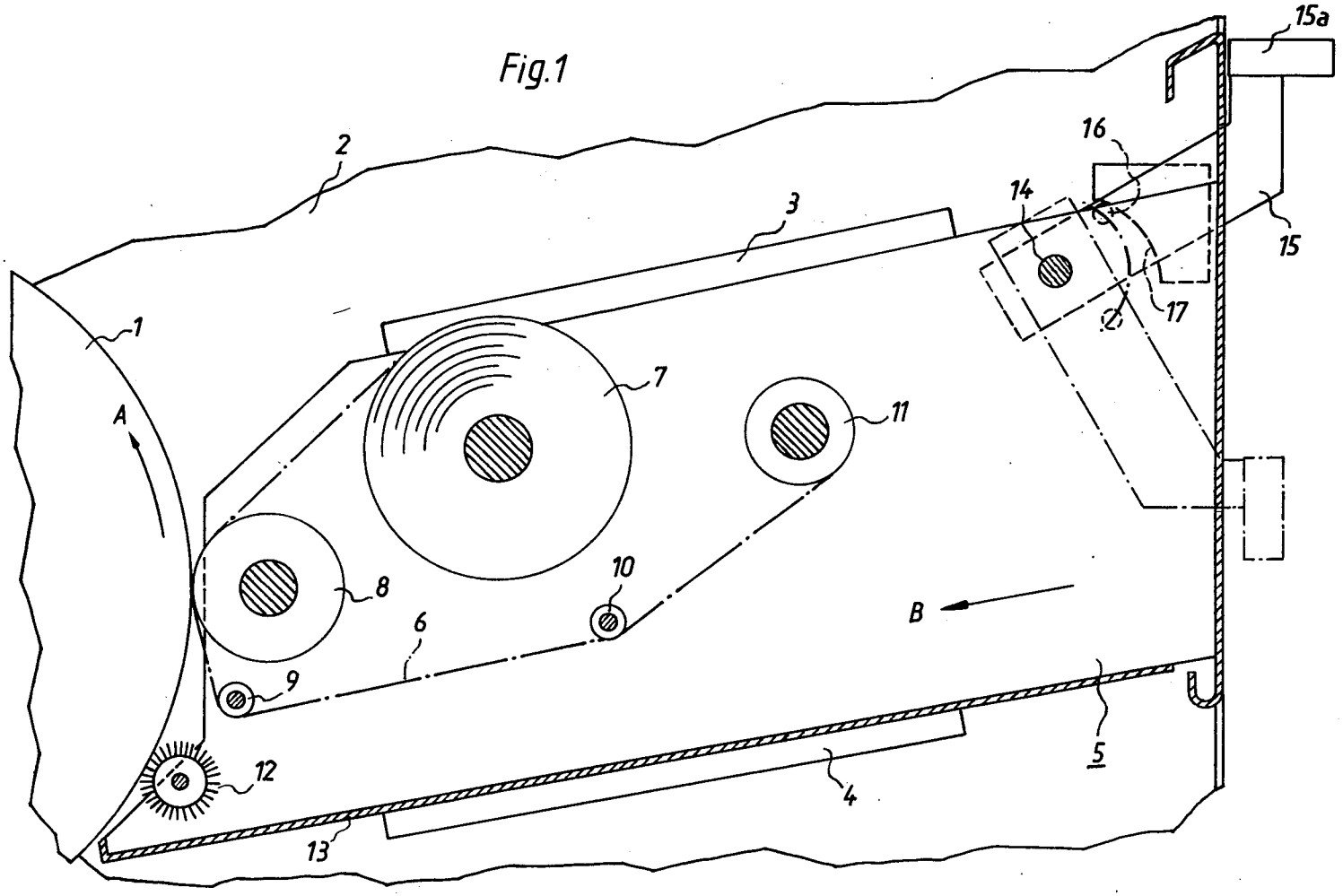
FIG. 1 is a fragmentary, somewhat diagrammatic section illustrating a part of an electrostatic copier embodying the invention.
Figure 2:
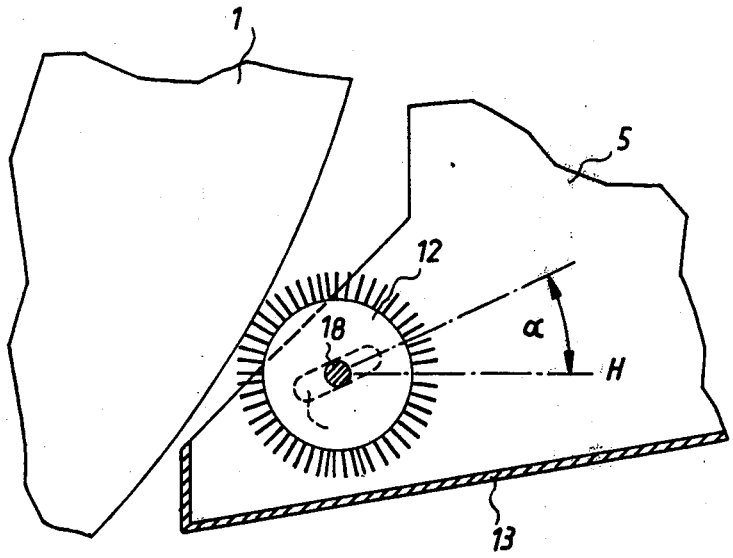
FIG. 2 shows, on an enlarged scale and in section, how the shaft of the brushroller in FIG. 1 is journalled.

In the embodiment illustrated in FIGS. 1 and 2, a drum-shaped endless rotary carrier 1 has a circumference which is provided with a (not-illustrated) photosensitive surface. The carrier 1 is journalled in a support 2, such as a frame, and is rotatable in the direction indicated by the arrow A.

Adjacent one region of the carrier periphery a cleaning station is provided. The components of the cleaning station are so constructed and assembled that they together form a module 5 which can be inserted into the machine, and removed from the same, as a unit. For this purpose the support 2 is provided with guide rails or bars 3, 4 on which the module 5 can slide into and out of the machine.

One component of the module 5 is in form of a supply or pay-out roll 7 which carries a coil of a tape-like or web-like cleaning material 6. Such material is widely used in this field for cleaning purposes. A spring-biased pressure roller 8 urges portions of the cleaning tape 6 against the surface of drum 1. The tape 6 is trained over guide rollers 9, 10 and is taken up by a take-up roller 11. The latter is driven intermittently by the drive (not shown) for drum 1 via a (similarly not shown) motion-transmitting arrangement, so that during each copying cycle a new, clean portion of the tape 6 is moved into engagement with the photosensitive surface of drum 1. This manner of advancing the tape, i.e., of driving the take-up roller 11, is known per se from the art.

To avoid the damage which results when toner carrier particles adhering to the surface of drum 1 travel to the cleaning station and are pressed against the photosensitive surface by the biased roller 8, the cleaning roller 12 is provided and engages the photosensitive surface of drum 1 upstream — as considered in the direction of rotation of drum 1 — of the roller 8. However, the brush roller 12 is not positively driven, as known from the prior art.

Instead, the brush roller 12 has a shaft 18 which extends parallel to the axis of rotation of drum 1. The end portions of shaft 18 are received in slots 19 which are inclined to the horizontal and are formed in opposite side walls of the unit 5. Shaft 18 is rotatable and also shiftable lengthwise of the slots 18. The size of the angle $\alpha$ included by the slots with the horizontal is determinative of the contact pressure with which the brush roller 12 engages the photosensitive surface of the drum 1, it being understood that it is the force of gravity which, in combination with the inclination of the slots 18, makes the brush roller rest against the drum surface. Toner carrier particles which are dislodged from the drum surface by the brush roller 12 drop onto the bottom wall 13 of the unit 5, where they accumulate for subsequent re-use.

Once inserted into the machine to the position shown in FIG. 1, the unit 5 must be arrested. For this purpose a lever 15 is pivotably mounted on a shaft 14 of the unit 5. Lever 15 carries a locking pin 16 which engages a cam face 17 provided on a stationary part of the machine. The cam face 17 is curved on a radius of curvature that is slightly smaller than the radius of curvature of the path in which the locking pin 16 travels when the lever 15 is pivoted between its lower (broken-like) end position and its upper (full-line) end position by means of the handle 15*a* which is accessible outside the machine. Therefore, pivoting of lever 15 from the lower to the upper end position imparts to the unit 5 a movement in direction of the arrow B, urging the roller 8 with the surrounding increment of the web 6 against the surface of drum 1 and locking the unit 5 in place by the cooperation of pin 16 and cam face 17.

The shaft 18 of the brush roller need not be mounted for translatory movement, i.e., longitudinally of the slots 19. Also, the roller 12 need not engage the periphery of drum 1 under influence of gravity and/or biasing forces of e.g., springs. However, the arrangement shown in the drawing has the advantage that appropriate selection of the biasing forces and/or the gravity forces (the latter by changing inclination of slots 19 to the horizontal) assures that the brush roller will always engage the drum periphery with the desired force, and that any need for a brush roller mount needing precision adjustments is eliminated.

By making the unit in such a way that it can be inserted and removed in toto, and by making the brush roller a part of the unit, the brush roller is automatically positioned relative to the drum, and engages the periphery of the same with the desired pressure, when the unit is inserted into the machine. This, in combination with the mounting of the brush roller shaft for translatory movement, assures that the brush roller always reliably assumes its desired position, independently of tolerance variations in the manufacture of the other components of the unit 5.

It will be understood that each of the elements described above, or two or more together, may also find a useful application in other types of applications differing from the types described above.

While the invention has been illustrated and described as embodied in an electrostatic copier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copier wherein an electrostatic image pattern is formed in the photoconductive surface of a rotatable endless carrier, toner and toner carrier particles are attracted to said pattern to form a visible image and are thereupon transferred to an image carrier and a cleaning web subsequently contacts a portion of the photoconductive surface to clean it in preparation for the formation of another image pattern, the improvement comprising a brush roller having an axis of rotation extending parallel to the axis of rotation of said endless carrier, said brush roller engaging said surface upstream of said portion as considered in the direction of rotation of said endless carrier and being rotated exclusively by frictional contact with said surface so as to remove from said surface carrier particles adhering thereto and prevent them from reaching said web.

2. The improvement as defined in claim 1, wherein said brush roller is of cylindrical configuration.

3. The improvement as defined in claim 1, said brush roller having a shaft; and further comprising means movably mounting said shaft so that the latter is free to move under the influence of force components acting upon said brush rollers in direction towards said surface.

4. The improvement as defined in claim 3, said means having a journalling slot wherein a portion of said shaft is turnably and shiftably received, said slot being inclined to the horizontal.

5. The improvement as defined in claim 1; further comprising means mounting said cleaning web and said brush roller so that they together form an assembly which is insertable into and withdrawable from said copier as a unit.

6. The improvement as defined in claim 1, wherein said brush roller has bristles.

7. In an electrostatic copier wherein an electrostatic image pattern is formed in the photoconductive surface of a rotatable endless carrier, toner and toner carrier particles are attracted to said pattern to form a visible image and are thereupon transferred to an image carrier and cleaning means subsequently contacts a portion of the photoconductive surface to clean it in preparation for the formation of another image pattern, the improvement comprising a brush roller having an axis of rotation extending parallel to the axis of rotation of said endless carrier, said brush roller engaging said surface upstream of said portion as considered in the direction of rotation of said endless carrier and being rotated exclusively by frictional contact with said surface so as to remove from said surface carrier particles adhering thereto and prevent them from reaching said cleaning means.

* * * * *